US006599223B2

(12) United States Patent
Wang et al.

(10) Patent No.: US 6,599,223 B2
(45) Date of Patent: Jul. 29, 2003

(54) MAGNETIC CONTROL MULTIFUNCTIONAL EXERCISE APPARATUS

(76) Inventors: Leao Wang, No. 1, Lane 233, Sec. 2, Charng Long Rd., Taiping 411 (TW); Peter Wu, No. 1, Lane 233, Sec. 2, Charng Long Rd., Taiping 411 (TW)

( * ) Notice: Subject to any disclaimer, the term of this patent is extended or adjusted under 35 U.S.C. 154(b) by 54 days.

(21) Appl. No.: 09/928,713

(22) Filed: Aug. 13, 2001

(65) Prior Publication Data

US 2003/0032535 A1 Feb. 13, 2003

(51) Int. Cl.[7] ..... A63B 21/00
(52) U.S. Cl. ..... 482/138; 482/4; 482/903
(58) Field of Search ..... 482/1–9, 51, 52, 482/70, 92, 98–103, 111, 133–143, 900–903

(56) References Cited

U.S. PATENT DOCUMENTS 5,569,138 A * 10/1996 Wang et al. ..... 482/130
5,711,749 A * 1/1998 Miller ..... 482/135
6,027,429 A * 2/2000 Daniels ..... 482/5

* cited by examiner

*Primary Examiner*—Glenn E. Richman
(74) *Attorney, Agent, or Firm*—Troxell Law Office PLLC; Kuo-Hsiung Chiu

(57) ABSTRACT

The present invention relates to a magnetic control multifunctional exercise apparatus and includes a base frame, an upright rod connected to a bottom of the base frame, a seat pad, a back pad, two hollow supporting arms pivotably connected at a top of the upright rod, a resisting arm pivotably connected at a front of the base frame and a magnetic control resisting mechanism connected to the base frame. A plurality of pulleys are utilized in combination with two ropes to connect the supporting arms, the resisting arm, and the magnetic control resisting mechanism so that a user can pull the ropes of the supporting arms or push the resisting arm. A flywheel of the magnetic control resisting mechanism will unidirectionally turn to achieve the expected magnetic resistance.

1 Claim, 6 Drawing Sheets

MAGNETIC CONTROL MULTIFUNCTIONAL EXERCISE APPARATUS

BACKGROUND OF THE INVENTION

1. Field of the Invention

The present invention relates to a magnetic control multifunctional exercise apparatus, and more particularly, to a device utilizing magnetic control resistance mechanism to create the resistance for achieving a better exercise effect.

2. Description of the Prior Art

First of all, referring to the attached document of U.S. Pat. No. 5,569,138, named "MULTI-PURPOSE EXERCISING APPARATUS", this invention belongs to the same inventor of the present invention. In this invention, two supporting arms for adjusting angle are disposed at two sides of the top of a base frame. An elastic rope extends from the inside of both supporting arms and is connected with a pull ring with which the upper limb of the user pulls. Meanwhile, the inside of the base frame is provided with another rope which extends to the front end of the base frame and is fixed to a resisting arm pivoted with the base frame, thereby enabling the user to use the lower limb to push the resisting arm for achieving an exercise effect of four limbs.

Though the aforementioned prior art is exactly applicable, the adjusting mechanism in design is too complicated (see FIGS. 2 and 3), thereby causing a great cost burden. Meanwhile, the fatigue of the elastic ropes will appear when they are used for a certain period. Moreover, no adjusting possibility of the elastic value is available. Thus, the exercising resistance can't meet the needs of the user for a long time.

SUMMARY OF THE INVENTION

It is a primary object of the present invention to remove the above-mentioned drawbacks and to provide a magnetic control multifunctional exercise apparatus in which the elastic rope is replaced with the magnetic control resisting mechanism whose exercising resistance is adjustable by an adjusting device. Moreover, a simplified supporting arm adjusting locating member is utilized to simplify the whole structure and to considerably reduce the manufacturing costs.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
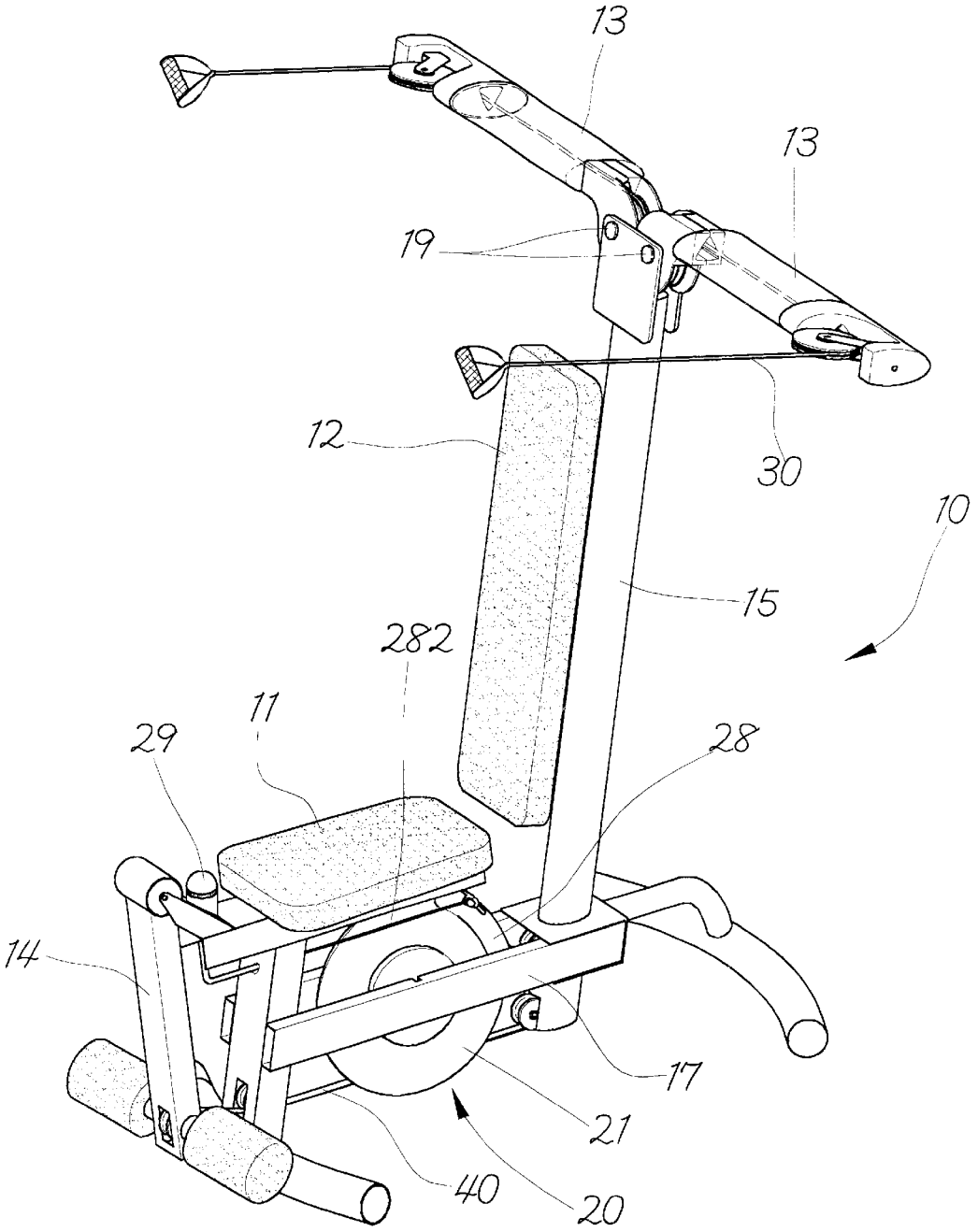
FIG. 1 is a perspective view of the present invention.
Figure 2:
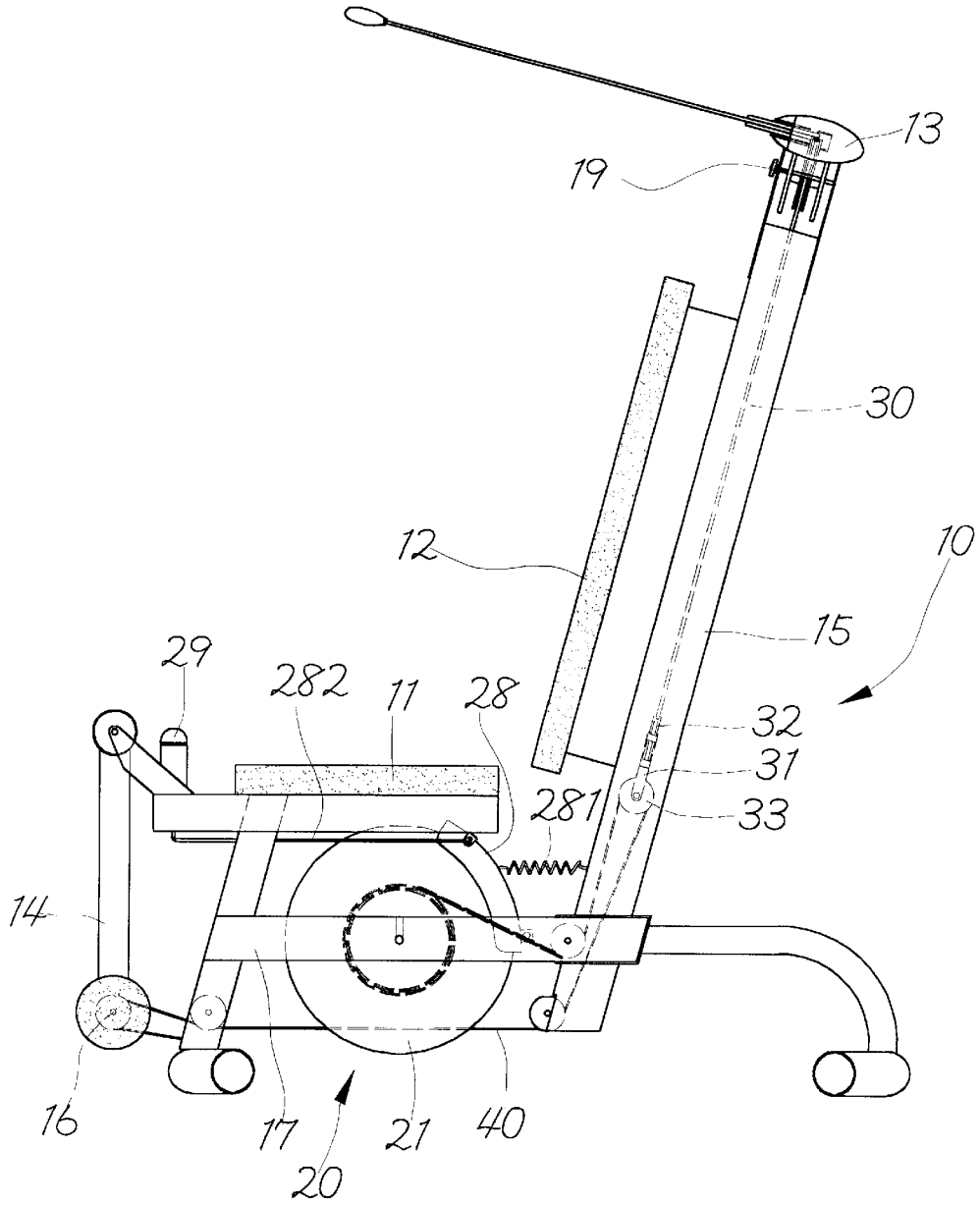
FIG. 2 is a side view of FIG. 1.

First of all, referring to FIGS. 1 and 2, a base frame 10 of the present invention includes a seat pad 11, an back pad 12, two hollow supporting arms 13 pivotably connected at the top thereof, a resisting arm 14 pivotably connected at the front end thereof and a magnetic control resisting mechanism 20 at the bottom thereof. A plurality of pulleys are utilized in combination with two ropes 30, 40 to connect with the supporting arms 13 and the resisting arm 14 so that the user can pull the ropes 30 of the supporting arms 13 or push the resisting arm 14. By means of the interconnection between the ropes 30, 40, a flywheel 21 of the magnetic control resisting mechanism 20 will unidirectionally turn to achieve the expected magnetic resistance.

The first rope 30 extends from one of the supporting arm 13 into a upright rod 15 of the base frame 10 while the upright rod 15 is provided with an up and down movable pulley block 31. Thereafter, the first rope 30 extends through an upper pulley 32 of the pulley block 31 and exits from another supporting arm 13. One end of the second rope 40 extends around a pulley 22 for many times and then goes upwards to enter into the upright rod 15 of the base frame 10. After the second rope 40 extends through a lower pulley 33 of the pulley block 31, it extends from the lower side of the base frame 10 in the direction of the resisting arm 14 at the front end of the base frame 10. After it extends around a limit pulley 16 in the resisting arm 14, the other end of the second rope 40 is fixed at a certain position of the base frame 10.

Figure 3:
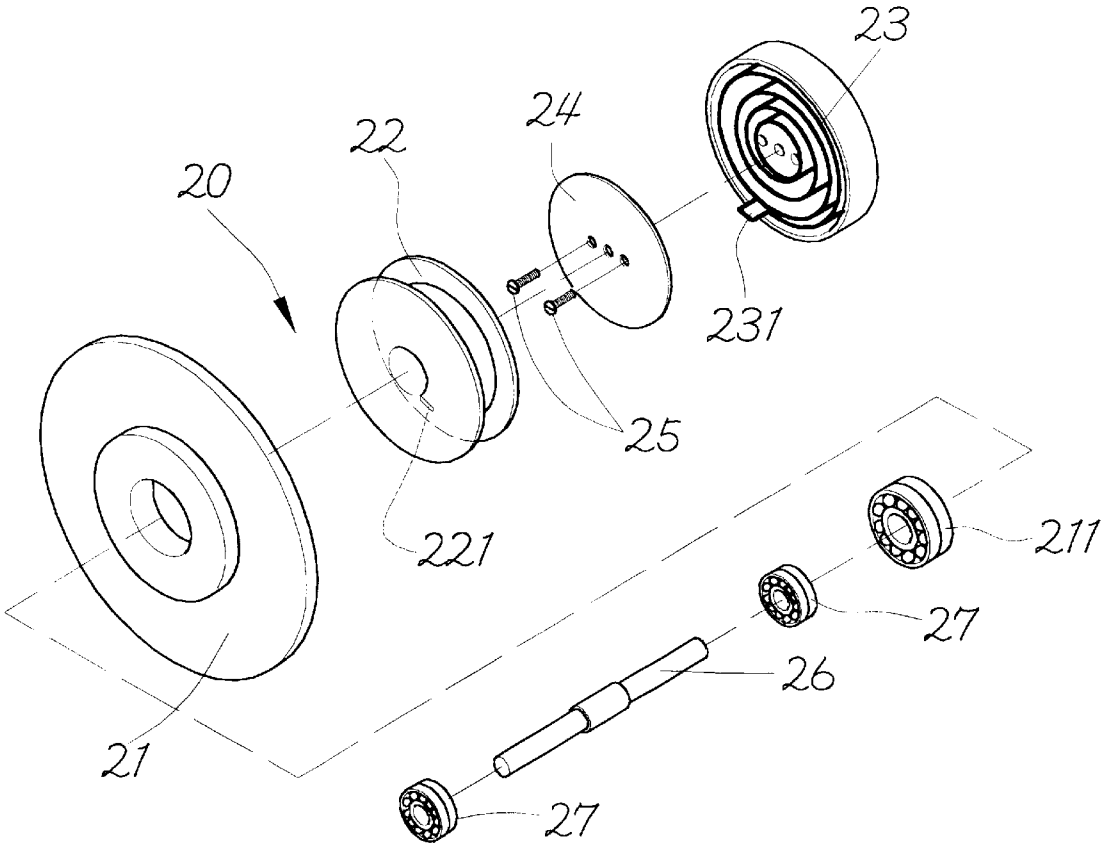
FIG. 3 is an perspective exploded view of a magnetic control resisting mechanism of the present invention.

As shown in FIG. 3, the magnetic control resisting mechanism 20 includes a flywheel 21, a pulley 22, a spring band 23, an outer cover 24 and several screws 25. The magnetic control resisting mechanism 20 is pivotably connected to a cross rod 17 of the base frame 10 by means of a shaft 26 and two bearings 27. The spring band 23 includes a projecting piece 231 to insert into a slot 221 of the pulley 22. Accordingly, when the pulley 22 rotates in a preset direction because the second rope 40 is pulled, the spring band 23 will be in a compressed state. After the external force disappears, the pulley 22 rotates in the reverse direction by means of the action of the spring band 23. Meanwhile, the second rope 40 restores itself. Besides, the flywheel 21 is inserted on the shaft 26 by means of a unidirectional bearing 211. When the pulley 22 rotates due to the pull force of the second rope 40, the flywheel 21 will be brought into a unidirectional rotation. When the pulley 22 rotates in the reverse direction because of the restoring force of the spring band 23, the flywheel 21 won't be influenced.

In addition, the flywheel 21 includes a magnet set 28 which is kept away from the flywheel 21 and the both don't contact with each other. In addition, a spring 281 is provided at the rear end of the magnet set 28 while a cable 282 and an adjusting device 29 are disposed at the other end of the magnet set 28. The clearance between the magnet set 28 and the flywheel 21 can be effectively adjusted by the extension part 29 and the cable 282 so that the exercising resistance of the flywheel 21 can be controlled.

Figure 4:
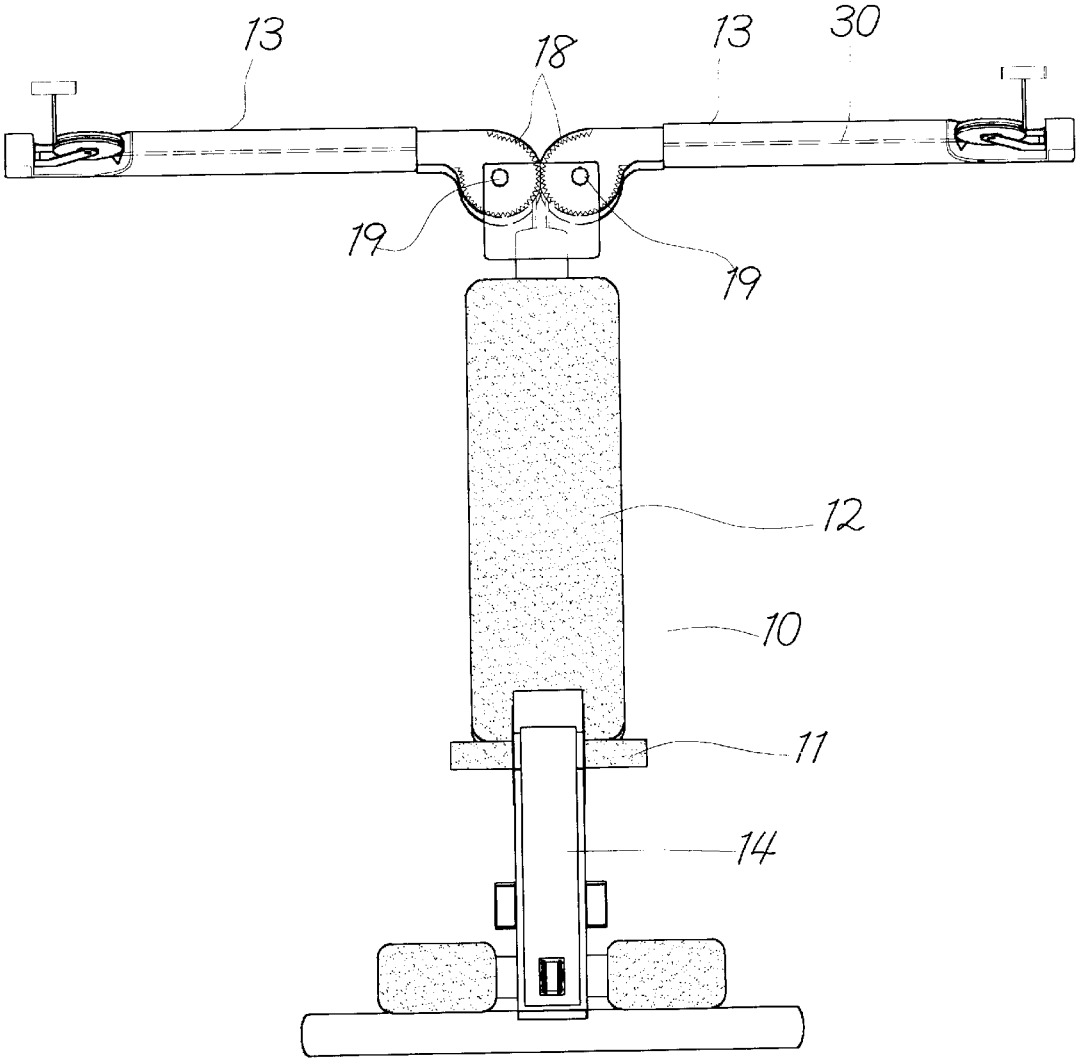
FIG. 4 is a front view of the present invention.
Figure 5:
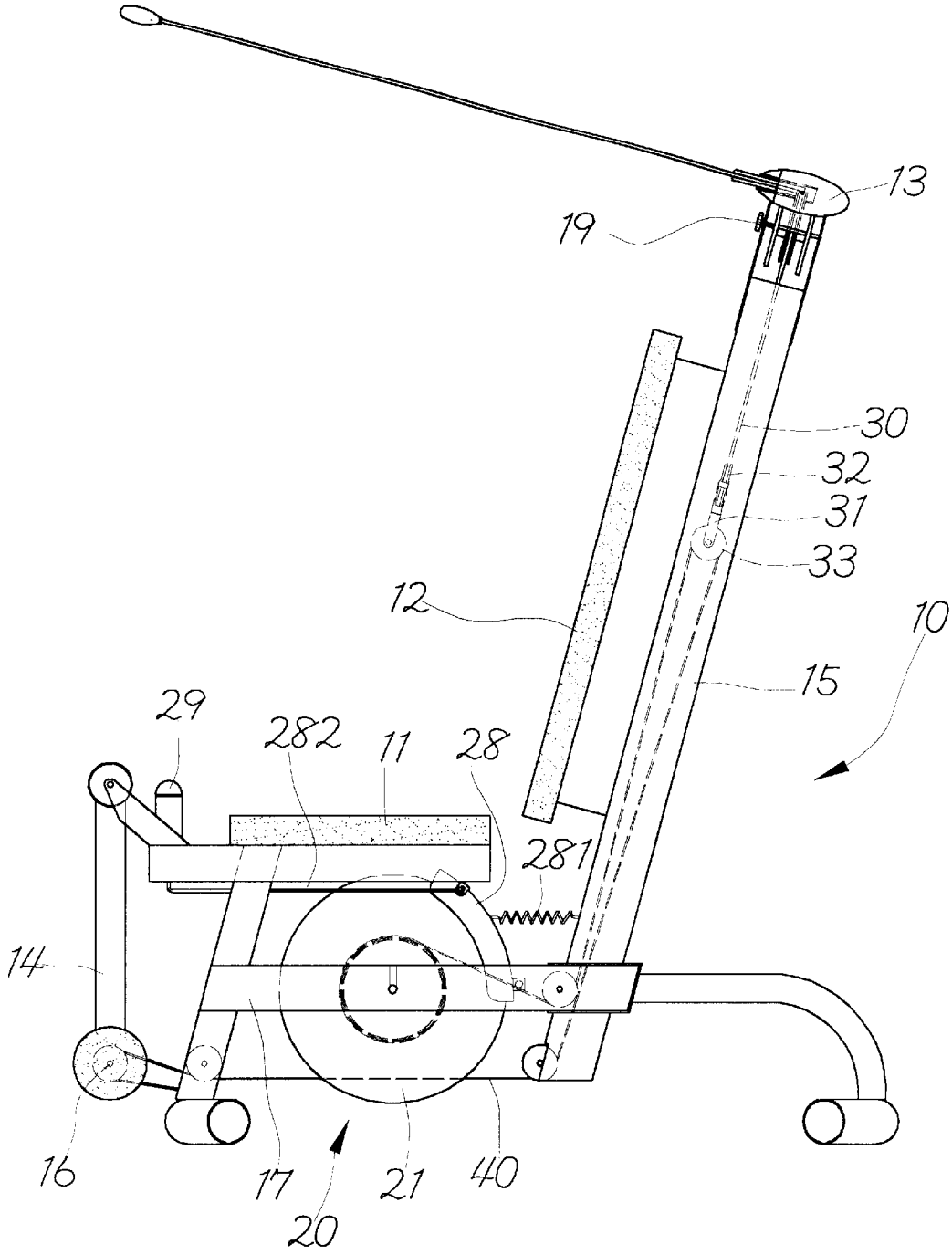
FIG. 5 is a schematic drawing of the action of the present invention.
Figure 6:
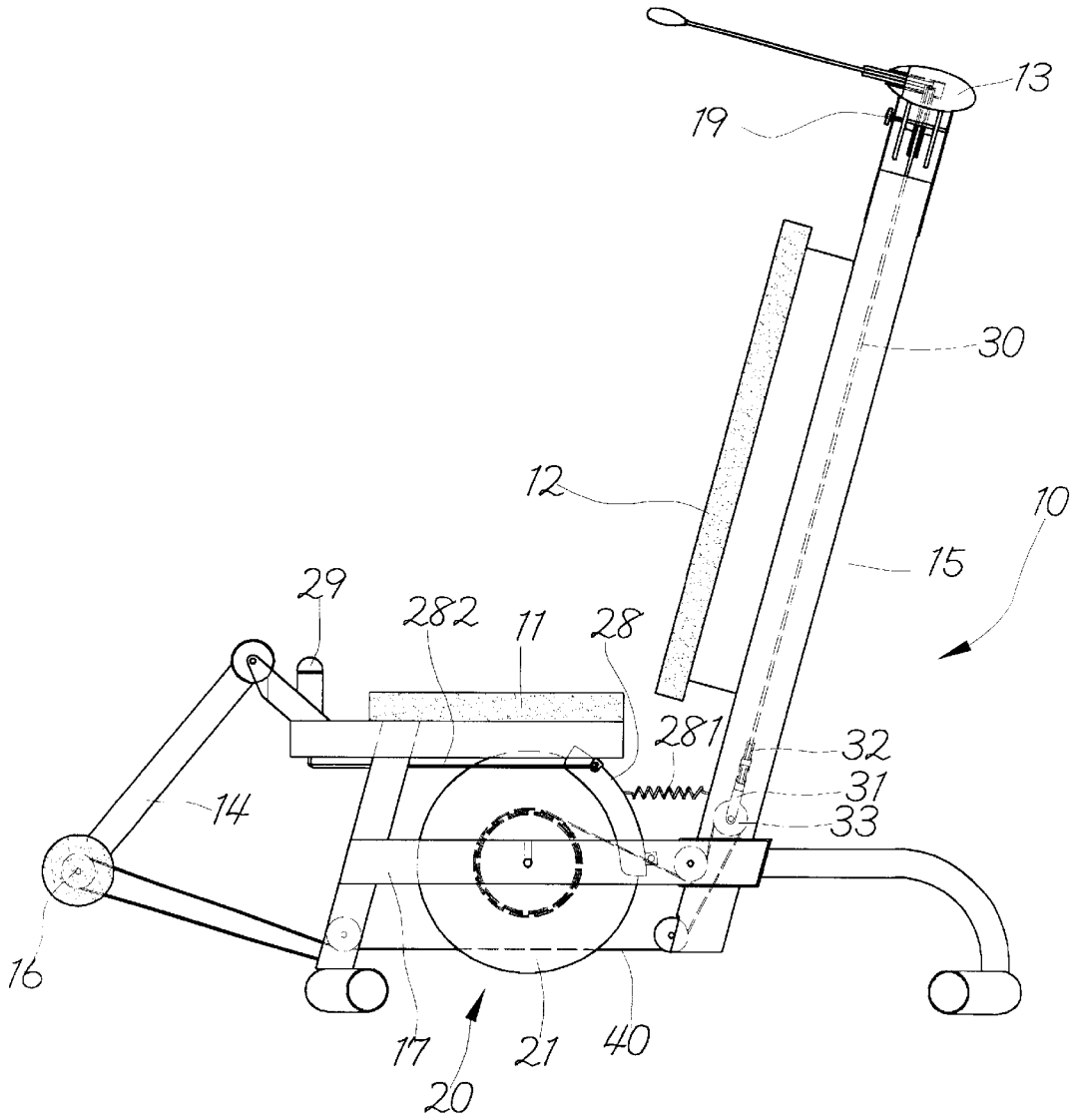
FIG. 6 is another schematic drawing of the action of the present invention.

As illustrated in FIG. 4, the adjacent side of both supporting arms 13 are fitted with teeth 18. A synchronic displacement is created by means of adjusting a locating knob 19 to get different exercising positions (see FIGS. 5 and 6).

The arrangement of the ropes 30, 40 is dependent upon several guide pulleys or limit pulley 16 for controlling the direction thereof and for preventing the ropes 30, 40 and the adjacent components from interference. These belong to the prior art and are not the features of the present invention so that further descriptions thereof are not given hereinafter.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A magnetic control multi-functional exercise apparatus comprising:

a) a base frame having a base frame front, a base frame bottom and a cross rod;

b) an upright rod having an upright rod top and an upright rod bottom, the upright rod bottom being connected to the base frame bottom;

c) first and second hollow support arms pivotally connected to opposite sides of the upright rod top;

d) a resisting arm pivotally connected to the base frame front;

e) a back pad connected to the upright rod between the upright rod top and bottom;

f) a seat pad connected to the base frame between the upright rod and the resisting arm;

g) a magnetic control resisting mechanism having a shaft, a flywheel rotatably adjoined to the shaft by a unidirectional bearing, a pulley rotatably connected to the shaft including a spring band that compresses as the pulley rotates from a first position and applies a force to return the pulley to the first position, the magnetic control resisting mechanism rotatably connected by the shaft to the cross rod;

h) a magnetic set adjacent to, but spaced from, the flywheel, the magnetic set including an adjusting device whereby a distance between the magnetic set and the flywheel is manually adjustable; and, i) an operating device having a plurality of pulleys and a plurality of ropes to operably connect the hollow support arms and the resisting arm to the magnetic control resisting mechanism.

* * * * *